United States Patent [19]

Korhonen et al.

[11] Patent Number: 4,460,415

[45] Date of Patent: Jul. 17, 1984

[54] METHOD FOR NITRIDING MATERIALS AT LOW PRESSURES USING A GLOW DISCHARGE

[75] Inventors: Antti S. Korhonen; Eero H. Sirvio; Martti S. Sulonen, all of Helsinki; Heikki A. Sundquist, Espoo, all of Finland

[73] Assignee: Kymi Kymmene Oy, Helsinki, Finland

[21] Appl. No.: 420,944

[22] Filed: Sep. 21, 1982

[30] Foreign Application Priority Data

Sep. 30, 1981 [FI] Finland ..... 813032

[51] Int. Cl.[3] ..... C23B 11/14

[52] U.S. Cl. ..... 148/16.6

[58] Field of Search ..... 148/16.6; 204/192 N

[56] References Cited

U.S. PATENT DOCUMENTS 3,616,383 10/1971 Klauesler ..... 148/16.6

4,297,387 10/1981 Beale ..... 204/192 N

FOREIGN PATENT DOCUMENTS 759694 10/1956 United Kingdom .

1555467 11/1979 United Kingdom ..... 148/16.6

2056218 3/1981 United Kingdom .

*Primary Examiner*—Peter K. Skiff

*Attorney, Agent, or Firm*—Cushman, Darby & Cushman

[57] ABSTRACT

A method for nitriding materials using a glow discharge in an atmosphere of nitrogen or gas mixture at a pressure between 1 . . . 100 mtorr (0.13 . . . 13.3 Pa). Nitriding treatment can be combined with a plasma aided coating process and the temperature control during both processes can be achieved with the aid of separate filament. Nitriding unit can be a separate rig or a part of the coating unit. The method can be used to increase the wear resistance of a work piece by increasing the hardness of its surface. Because of the low pressure used in the nitriding process the same equipment can be used to produce a separate hard and wear resistant compound or alloy coating on the nitrided surface to further increase the hardness of the uppermost surface. The main field of the method is in increasing the wear and corrosion resistance of machine parts and tools.

3 Claims, 4 Drawing Figures

METHOD FOR NITRIDING MATERIALS AT LOW PRESSURES USING A GLOW DISCHARGE

FIELD OF THE INVENTION

This method concerns nitriding of various materials at low pressures (1 . . . 100 mtorr; 0.13 . . . 13.3 Pa) in an atmosphere containing nitrogen or a mixture of other gases and nitrogen exited to a glow discharge.

DESCRIPTION OF THE PRIOR ART

So far it has been generally known that metal objects can be nitrided with the aid of high voltage and proper gas pressure. This method is called plasma nitriding or ion nitriding. On the contrary it has not been known what pressures can generally be applied or guarantee the optimum result.

The first American attempts to apply high voltage were done in an atmospheric pressure (Egan, J., U.S. Pat. No. 1,837,256. 1930). The control of the process was complicated because of sparking and arc formation. A major improvement in the method was developed later on in Germany by Berghaus. In his patent (DE No. 668 339, 7.12.1938) a treatment carried out at a lower pressure is presented. The advantage of this method was the considerably improved control of the process. The method of Berghaus was based on so called abnormal glow discharge. Later developments in Germany and in the United States led finally to the industrial application of low pressure (about 1 . . . 10 torr; 0.13 . . . 1.3 kPa) glow discharge in nitriding during 1960's and 1970's. Commercial units are nowadays in operation in several countries (see for example Edenhofer, B., The Metallurgist and Materials Technologist 8 (1976) pp. 421–426).

The plasma nitriding or ion nitriding methods now in use are based on the use of a glow discharge created in aforementioned pressures. Nitrogen ions and neutral atoms bombard the surface of the work piece and even eject atoms out of it (sputtering). When the ions or neutrals collide with work piece, which serves as a cathode, they convert most of their kinetic energy to heat. In this way it is possible to achieve the temperature (about 400° . . . 600° C.) required for the high diffusion rate of nitrogen without external heating.

In the process described above the pressure range is not especially low (about 1 . . . 10 torr; 0.13 . . . 1.3 kPa). Considerably lower pressures have, however, not been specifically studied in nitriding. On the general effects of lower pressures it is generally known that when the pressure is lowered the glow discharge zones close to cathode will expand until the so called negative glow totally disappears and the glow discharge consists of the cathode layers or of the so called cathode glow only (see for example Nasser, E., Fundamentals of gaseous ionization and plasma electronics, John Wiley, 1971, pp. 400–405). In this cathode glow no clearly defined layers can be distinguished. This kind of cathode glow is typical to the process considered here as will be shown later on.

It can, however, be assumed that the free path of the gas atoms and ions between the collosions increases at low pressures (see for example Chapman, B., Glow discharge processes, John Wiley, 1980, pp. 9–10). This might lead to a more energetic bombardment of the surface of the work piece leading to a more effective nitriding.

SUMMARY OF THE INVENTION

This invention is based on a glow dishcarge maintained at lower pressures (1 . . . 100 mtorr) of nitrogen or nitrogen containing gas mixtures than in previous processes. Several of the modern coating processes, for example ion plating (see for example Mattox, D.M., Mechanisms of ion plating. Proc. of the Int. Conf. on Ion Plating and Allied Techniques (IPAT 79), London, July 1979, pp. 1–10), are operated in this pressure range. If a work piece could be nitrided using a low pressure (1 . . . 100 mtorr), it could be of a considerable industrial importance to, for example, combine plasma nitriding and ion plating to create hard and wear resistant surfaces and thick diffusion layers.

Low pressure plasma nitriding has been shown above to have some potentional advantages. As a consequence of enhanced ion bombardment a nitriding treatment could probably be carried out in a short period; in few hours compared to 100 hours needed for conventional nitriding. The probability of arcing also diminishes andd this could improve the stability of the process and even make the separate arc prevention equipment used in previous processes unnecessary.

In the literature there is, however, no information on plasma nitriding process carried out in low pressures 1 . . . 100 mtorr (0.13 . . . 13.3 Pa) and so the above-mentioned assumptions have to be confirmed experimentally.

BRIEF DESCRIPTION OF THE DRAWING

In the accompanying drawing

DESCRIPTION OF THE PREFERRED EMBODIMENTS

Figure 1:
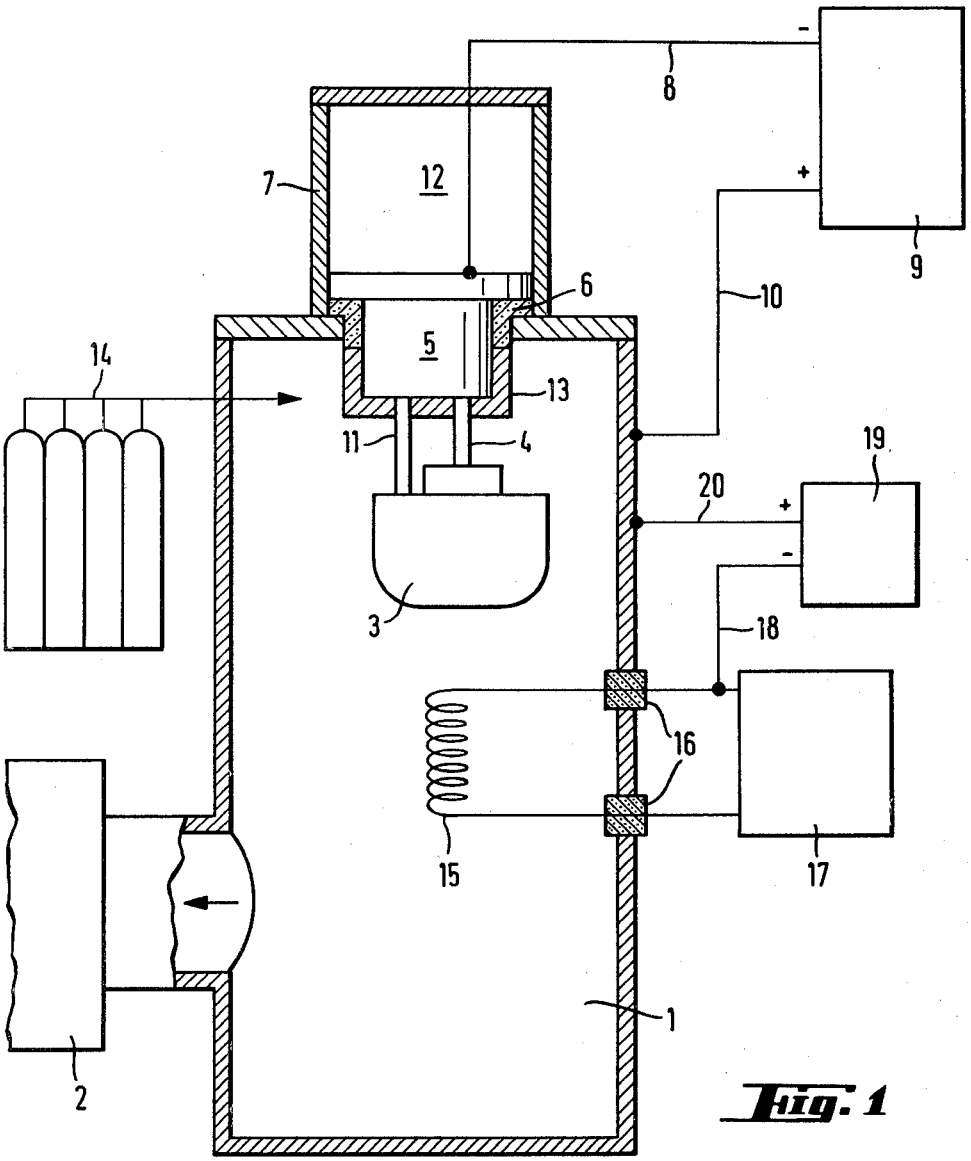
FIG. 1 shows schematically an apparatus for carrying out the method of the invention.

The apparatus used in the experiments is shown schematically in FIG. 1. The vacuum chamber 1 where the treatment is carried out is evacuated by the use of pumps 2. The work piece 3 is connected to the cathode 5 for example by the help of bolt 4. The cathode is insulated from the chamber walls by an insulating bushing 6. The cathode is also separated from the environment by a spark cover 7. The cathode is biased negatively through a lead 8 with a power source 9 up to a voltage of 4 kV. The chamber walls are connected as an anode through a lead 10. The temperature of the work piece is monitored using a thermocouple 11 and the measuring unit 12 is located in a separate cover 7 insulated from its surroundings. The cathode is surrounded by a shield 13 limiting the glow around the workpiece 3. Properly mixed gas mixture 14 is lead into the chamber and the pressure in the chamber is adjusted. The intensity of the glow discharge can, if so required, be improved by a hot filament 15 which is connected to a power source 17 using lead throughs 16. The negative bias of the filament can be adjusted using the circuit 18 with a power source 19 up to a voltage of 200 V. The vacuum chamber is connected as an anode 20 to the power source 19.

Figure 2A:
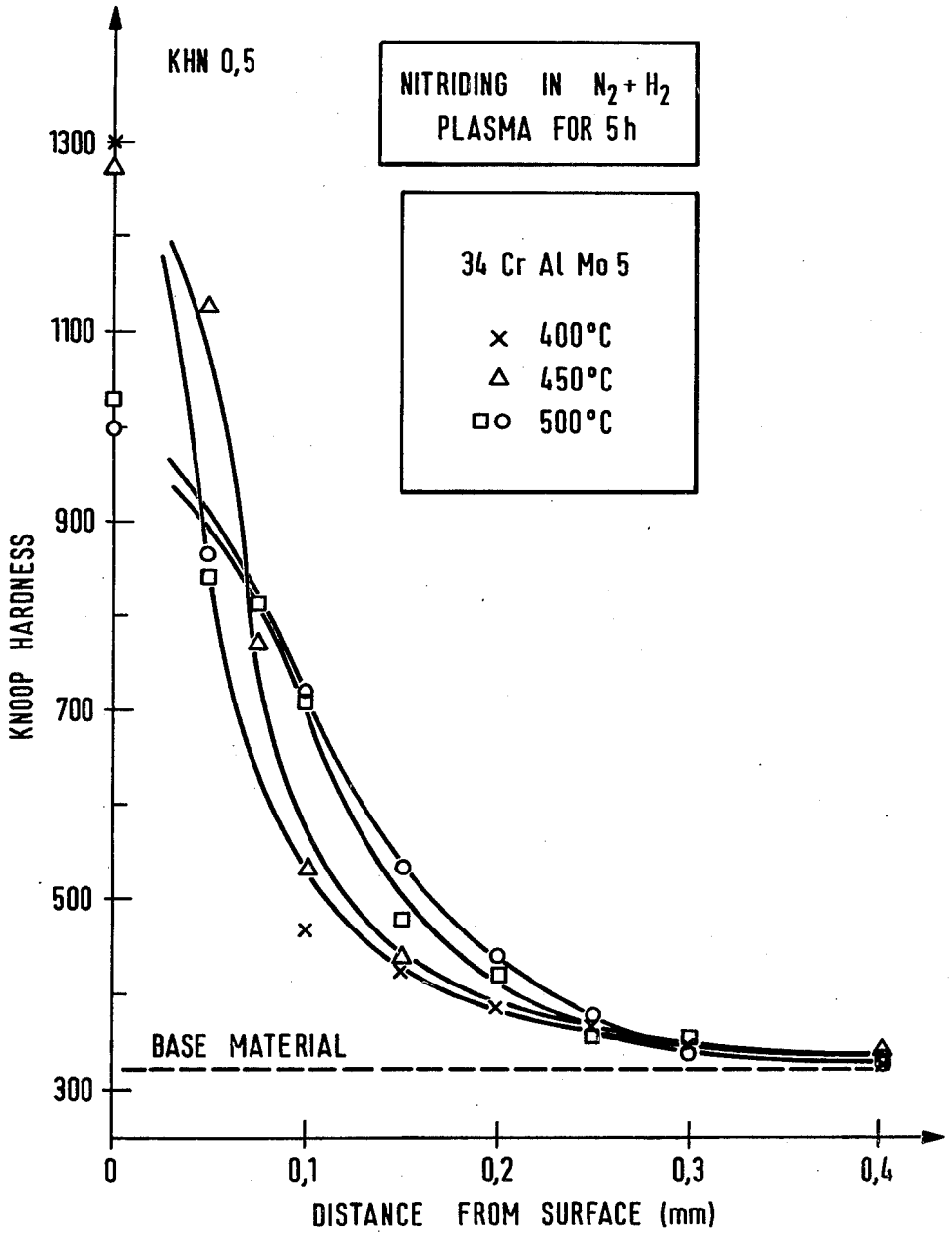
FIG. 2 illustrates the hardness distribution obtained by the method with two different steels.
Figure 2B:
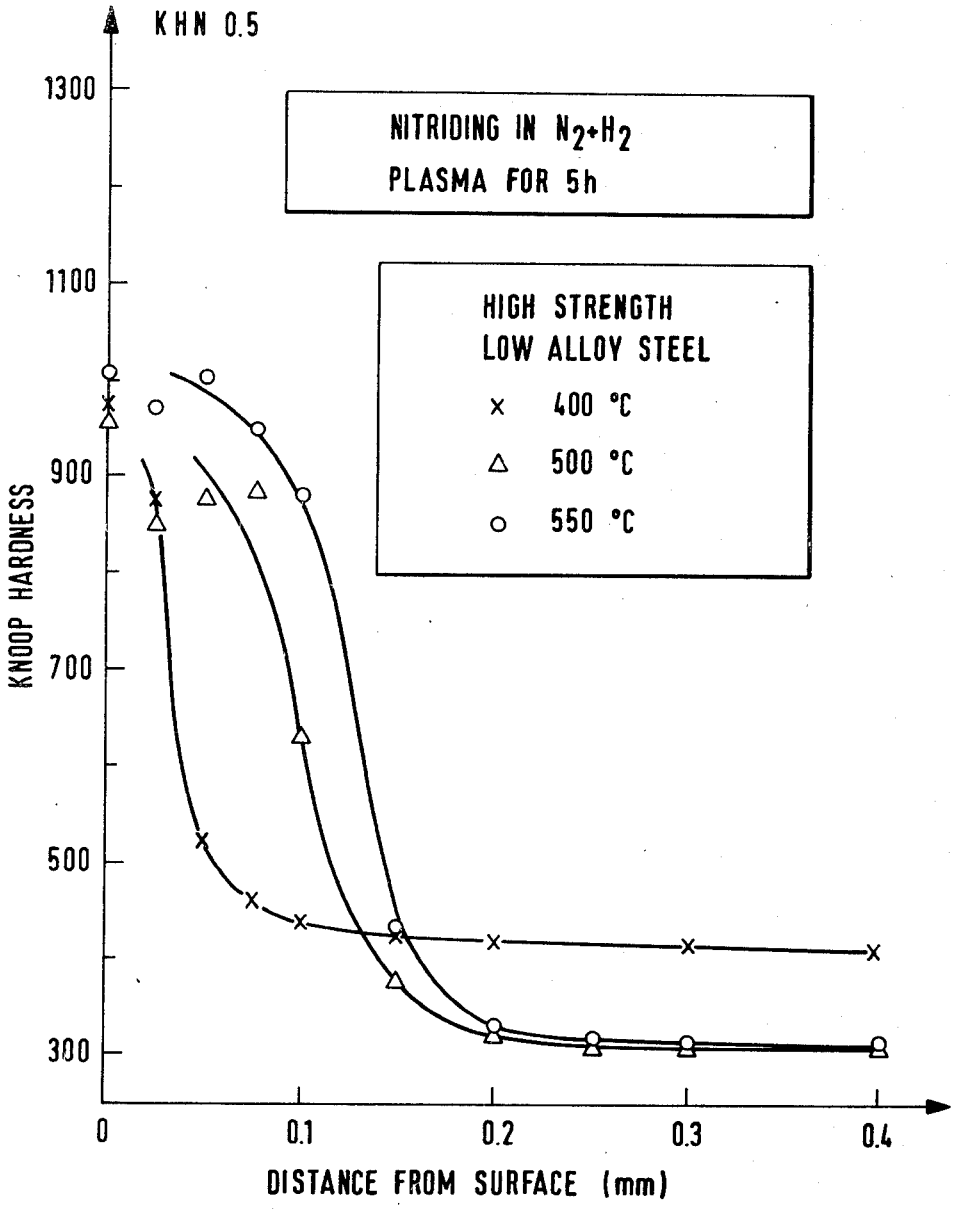

The hardness distributions for a nitriding steel and a low-alloy high-strength steel obtained by this nitriding process are shown in FIGS. 2*a* and *b*. The nitrogen pressures used in the experiments varied from 10 . . . 60 mtorr and the temperature was adjusted by changing the pressure, voltage or the power supplied through the filament. Hardness distributions show that the depths of the diffusion zones are sufficient despite the low treatment temperatures and treatment times (5 hours in the experiments). If so desired the diffusion zone depth can of course be increased by increasing the treatment time.

Figure 3A:
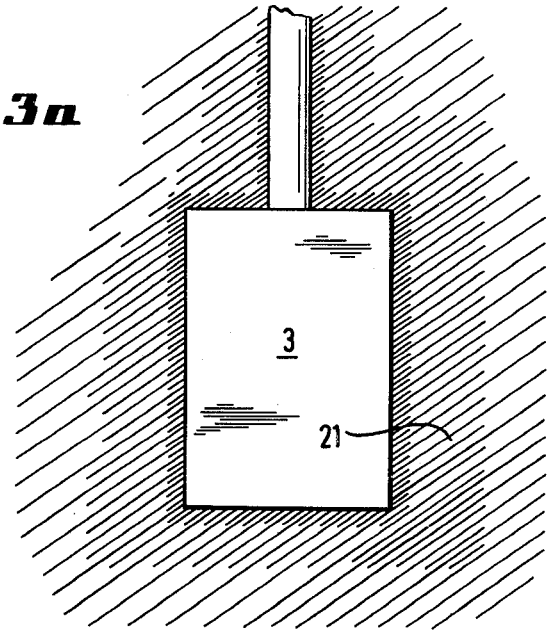
FIG. 3 illustrates schematically the influence of pressure on glow discharge, and FIG. 4 show the result of x-ray diffraction measurement on work pieces treated by the method.
Figure 3B:
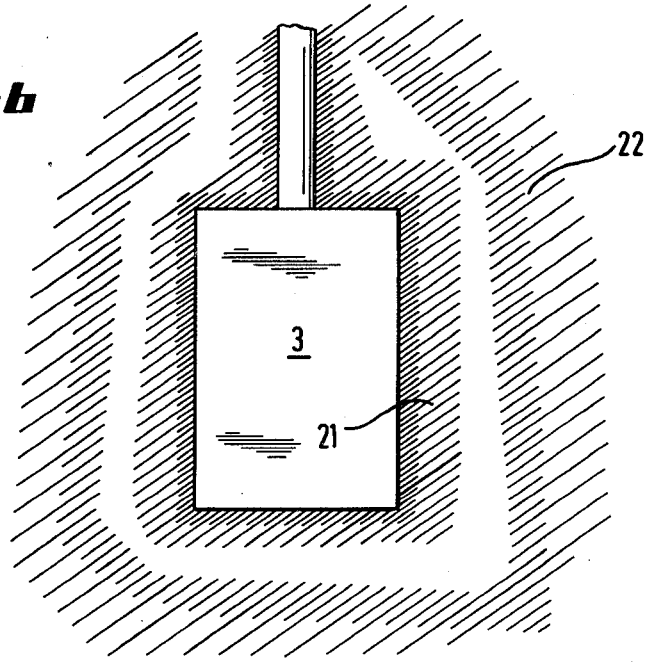

A schematic illustration of the observations of the influence of pressure on a glow discharge is shown in FIGS. 3*a* and *b*. As the pressure rises a negative glow 22 (FIG. 3*b*) appears around the work piece in addition to the cathode glow 21. When the negative glow of the method of this invention (FIG. 3*a*) is compared to that of a conventional plasma nitriding (FIG. 3*b*) it can be seen that the nature of the glow changes markedly when the pressure is reduced. The negative glow 22 appearing in a conventional plasma nitiriding process is missing in the process of this invention.

Figure 4:
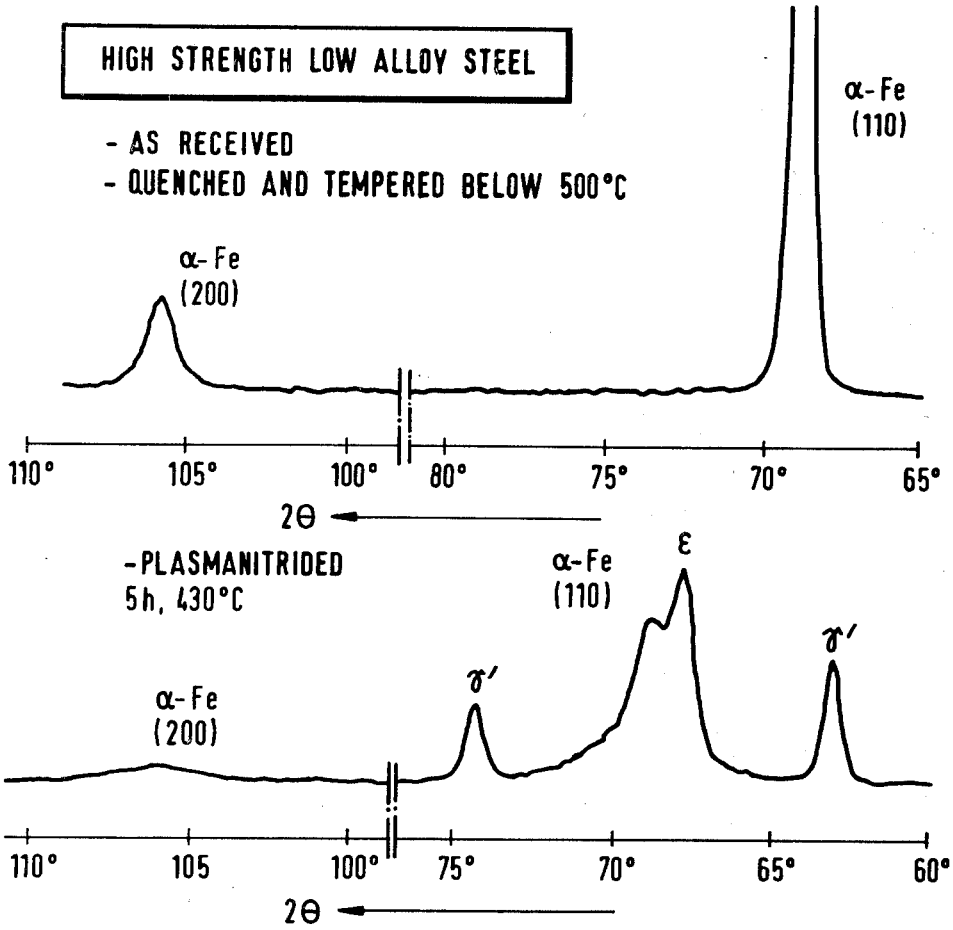

An example of x-ray diffraction measurement results of work pieces plasma nitrided with this new method have been illustrated in FIG. 4. When comparing the diffraction curves of nitrided specimen to that of untreated specimen it can be found that $\gamma'$-($Fe_4N$) and $\epsilon$-($Fe_{3-2}N$) nitrides have been formed during nitriding. The composition and thickness of compound layer can be altered by changing the process variables (gas mixture used, pressure, treatment time etc.).

A new method for plasma nitriding at pressures much lower than previously used have been illustrated above. Because of the enhanced ion bombardment at lower pressures the treatment times are short and a risk of arcing diminishes compared to the conventional plasma nitriding. The nature of the glow discharge changes also as a result of the lower pressure as assumed. This can be verified by the disappearance of the negative glow. The method can be also easily combined with for example ion plating or sputtering to create a hard and wear resistant coating on the hardened nitrogen diffusion layer.

What is claimed is:

1. A method for nitriding work pieces with the aid of a glow discharge of nitrogen or a gas mixture containing nitrogen, comprising applying a gas pressure of from 1 to 100 mtorr and controlling the temperature of the work piece and the ion current to the work piece by a separate negatively biased filament.

2. A method as claimed in claim 1 applied in combination with ion plating or another comparable plasma aided coating method or preceeding or following such a treatment.

3. In a method for nitriding a surface of a work piece located in a chamber which method includes providing in the chamber a gaseous atmosphere containing nitrogen cathodically connecting the work piece to a high voltage source and anodically connecting the chamber to the source to produce a glow discharge and an ion current between the work piece and the chamber whereby the work piece is heated and whereby nitrogen diffuses into a surface of the work piece, the improvement which comprises adjusting the pressure of the nitrogen-containing atmosphere to the range 1 to 100 mtorr, and controlling the temperature of the work piece and the ion current to the work piece by providing in the chamber a heated filament and negatively biasing the filament by electrically connecting it to a voltage source separate from the power source which negatively charges the work piece.

* * * * *